United States Patent [19]

Viscasillas

[11] Patent Number: 4,546,879

[45] Date of Patent: Oct. 15, 1985

[54] TAPE DISPENSER

[75] Inventor: Fernando Viscasillas, Barcelona, Spain

[73] Assignee: Velcro Española, S.A., Barcelona, Spain

[21] Appl. No.: 688,270

[22] Filed: Jan. 2, 1985

Related U.S. Application Data

[63] Continuation of Ser. No. 345,069, Feb. 2, 1982, abandoned.

[30] Foreign Application Priority Data

Feb. 26, 1981 [ES] Spain ..... 256482[U]

[51] Int. Cl.[4] ..... B65D 85/04

[52] U.S. Cl. ..... 206/391; 206/408; 206/411; 206/461

[58] Field of Search ..... 206/391, 393, 394, 408, 206/411, 461

[56] References Cited

U.S. PATENT DOCUMENTS

| | | | |
|---|---|---|---|
| 2,628,042 | 2/1953 | Fitts et al. | 206/391 |
| 2,848,104 | 8/1958 | Schor et al. | 206/391 |
| 3,202,269 | 8/1965 | Lewis et al. | 206/461 |
| 3,302,781 | 2/1967 | Rudnick | 206/391 |
| 3,841,475 | 10/1974 | Ellis | 206/461 |
| 3,881,257 | 8/1975 | Chasen | 206/461 |
| 3,958,768 | 5/1976 | Fairbanks | 206/391 |
| 4,210,246 | 7/1980 | Kuchenbecker | 206/461 |
| 4,249,658 | 2/1981 | Ogura | 206/461 |

*Primary Examiner*—Joseph Man-Fu Moy
*Attorney, Agent, or Firm*—Blum Kaplan Friedman Silberman & Beran

[57] ABSTRACT

A dispenser is provided to hold and dispense two tapes of the type which have removably interengageable surfaces. The dispenser is in the form of an elongated hollow container that about midway of its length is provided with a groove-shaped outward flaring passage that extends from a slot that is formed in the encircling wall between the two main walls. The container accommodates two spirally wound tapes, the end portions of which are interengaged and project through the slot.

5 Claims, 2 Drawing Figures

TAPE DISPENSER

This is a continuation of application Ser. No. 345,069, filed Feb. 2, 1982, now abandoned.

BACKGROUND OF THE INVENTION

The invention relates to a tape dispenser, and relates more particularly to a tape dispenser that dispenses two tapes the ends of which as they emerge from the dispenser adhere to each other. These tapes, which may be sealing tapes are of the type that removably coadhere along one surface of each. These surfaces may interengage by being specially prepared. For example these surfaces may interengage removably by means of a plurality of small hooks or stems with a head and similar objects that is provided on a surface of one of the tapes, and they fasten on small rings formed on the surface of the other tape; for example, this removable co-adherence may be provided by means of "Velcro" fasteners. Such tapes have many uses, for example on garments and in the home.

SUMMARY OF THE INVENTION

One of the principal objects of the invention is to provide a dispenser that will hold two tapes arranged one adjacent the other, each in spiral form, and that have the specially prepared surfaces on the exterior, and the end portions of which interengage removably along said surfaces, and the thus coadhering end portions of the tape project through a slot in the dispenser wall into a passage from which the coadhering tapes may be pulled.

Further objects and advantages of the invention will be set forth in part in the following specification and in part will be obvious therefrom without being specifically referred to, the same being realized and attained as pointed out in the claims hereof.

With the above and other objects of the invention in view, the invention consists in the novel construction, arrangement and combination of various devices, elements and parts, as set forth in the claims hereof, certain embodiments of the same being illustrated in the accompanying drawings and described in the specification.

BRIEF DESCRIPTION OF THE DRAWINGS

The foregoing and other objects of the invention will be best understood from the following description of exemplifications thereof, reference being had to the accompanying drawings, wherein.

DESCRIPTION OF THE PREFERRED EMBODIMENTS

Figure 1:
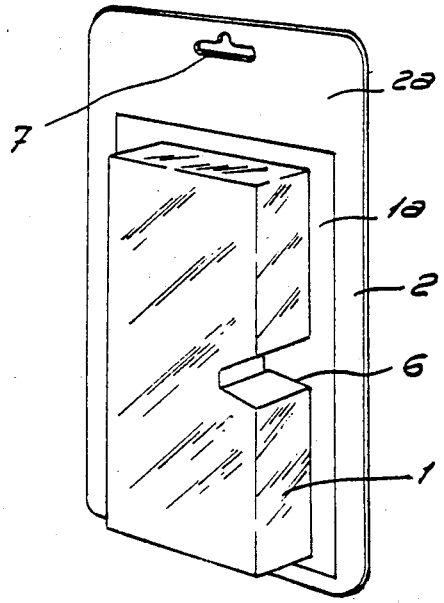
FIG. 1 is a perspective view of a dispenser in accordance with one embodiment of the invention.
Figure 2:
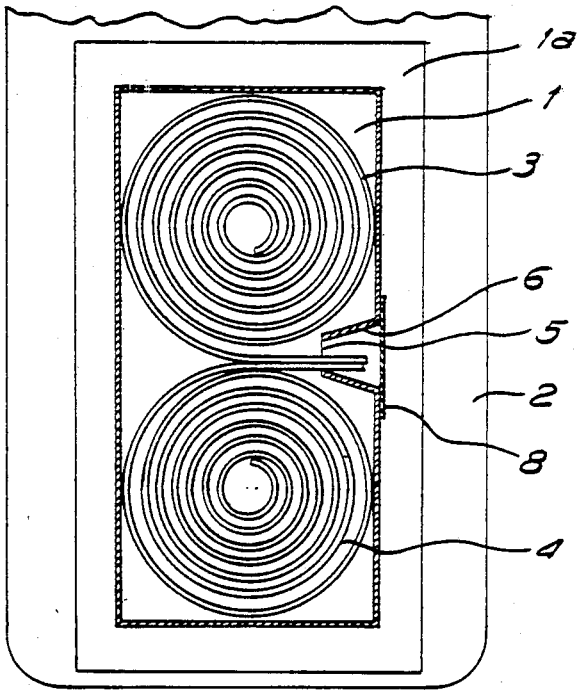
FIG. 2 is a longitudinal sectional view, taken on a middle plane of FIG. 1, embodying a modification.

In carrying the invention into effect in the embodiments which have been selected for illustration in the accompanying drawings and for description in this specification, and referring now particularly to FIG. 1, there is provided a container 1 which holds, and is capable of dispensing, tapes 3 and 4 (FIG. 2).

The container 1 is a hollow elongated body, for example of parallelepiped form, and has two main walls, namely a front wall (FIG. 1) and a rear wall 2. These two main walls are spaced apart from each other, and there is disposed an encircling wall in between the two main walls, and is connected to the main walls. The front main wall and the encircling wall may be molded of a suitable plastic material. The other main wall 2 may be in the form of a support strip, and may, for example, be made of cardboard or any other suitable material, to which the encircling wall is connected, for example by means of a flange 1*a*. The encircling wall may, of course, also be connected to the main wall 2 in any other suitable way.

The container 1, as best shown in FIG. 2, supports on its interior two spirally wound tapes 3 and 4, respectively. Each of these tapes has a specially prepared surface to engage a correspondingly prepared surface of the other tape for releasable adhesion thereto, for example, as previously mentioned, of the "Velcro" type.

As shown in FIG. 2, the major portions of the tapes 3 and 4 are out-of-contact, and the specially prepared surfaces are externalized, which means they are on the exterior of each spiral, and their end portions are interengaged along adjacent portions of the respective external surfaces of the tapes 3 and 4.

The encircling wall defines about midway of the length of the container an opening from which a tapered passage or recess 6 extends inwardly towards an opening 5. At least the front main wall is recessed or cut away correspondingly, to impart to said passage a groove-shape with outward flaring sides that extend from the slot 5 to the opening. The slot 5 has a smaller area than the opening.

In accordance with the modification shown in FIG. 2, the opening may be temporarily sealed with a piece of adhesive tape 8.

The two strips of tape 3 and 4 remain perfectly protected inside the holder, and they may be used as they are needed by the operator, by removing them by pulling on their coadhering ends, whereupon the tapes will gently unwind.

In the preceding description, certain terms have been used for the sake of clarification, such as "front" wall and "rear" wall. This has been done only for the sake of clarity and simplicity, and not in any limiting sense.

For upright positioning of the dispenser, the wall 2 is provided with means, such as a slot 7, for suspending the container 1 at one of its short sides.

While the preferred embodiments of the invention have been described in considerable detail, it will be apparent to those skilled in the art to which it relates that the invention is not limited to a particular type of material, nor to all of the exact details of shape and configuration shown and described.

It is also to be understood that the invention contemplates means other than those shown for supporting the two tapes and for promoting their withdrawal.

It is my intention to cover hereby all adaptations, modifications and uses of the invention which it relates and the scope of the appended claims.

I claim:

1. A dispenser, for use in holding and dispensing two tapes of substantially equal thickness each having a prepared surface operative to engage a correspondingly prepared surface of the other tape for adhesion thereto, comprising in combination, an elongated hollow container including two main walls spaced apart from each other and an encircling wall therebetween and connected thereto, said container being adapted to support on its interior said tapes in spaced relation each spirally wound with their prepared prepared surfaces externalized so that said prepared surfaces face one another but remain uncoupled, said encircling wall defining about midway of the length of the container an opening, portions of at least some of said walls establishing a tapered passage extending inwardly from said opening and terminating in a slot, said passage being adapted to receive the protruding end pieces of said tapes to facilitate the grasping of said end pieces by an operator from the exterior so that said tapes are releaseably coupled as they are pulled through said opening to insure that equal lengths of said two tapes are removed from said container.

2. A dispenser, as claimed in claim 1, said slot having a smaller area than said opening, said passage flaring outwardly along two sides of said encircling wall from said slot to said opening.

3. A dispenser, as claimed in claim 1, one of said main walls establishing means for suspending said container near one of its short sides so that the container will be disposed lengthwise uprightly.

4. A dispenser, as claimed in claim 1, and means operable for removably covering said opening.

5. A dispenser, as claimed in claim 1, portions of at least one of said main walls being recessed adjacent said passage whereby the passage assumes outward flaring groove shape.

* * * * *